US005855390A

United States Patent [19]

Hassell

[11] Patent Number: 5,855,390

[45] Date of Patent: Jan. 5, 1999

[54] LATERALLY FLEXIBLE SNOWBOARD BINDING SYSTEM

[76] Inventor: Christopher S. Hassell, 432 Pheasant Run, Louisville, Colo. 80027

[21] Appl. No.: 931,945

[22] Filed: Sep. 17, 1997

[51] Int. Cl.[6] ..... A63C 9/00

[52] U.S. Cl. ..... 280/607; 280/14.2; 280/618

[58] Field of Search ..... 280/14.2, 607, 280/616, 617, 618, 623, 626, 627, 633

[56] References Cited

U.S. PATENT DOCUMENTS

| | | | |
|---|---|---|---|
| 5,028,068 | 7/1991 | Donovan | 280/14.2 |
| 5,520,406 | 5/1996 | Anberson et al. | 280/14.2 |
| 5,556,123 | 9/1996 | Fournier | 280/14.2 |
| 5,577,755 | 11/1996 | Metzger et al. | 280/14.2 |
| 5,695,210 | 12/1997 | Goss et al. | 280/14.2 |
| 5,713,594 | 2/1998 | Jenni | 280/14.2 |

*Primary Examiner*—Richard M. Camby

*Attorney, Agent, or Firm*—Joseph C Herring

[57] ABSTRACT

The new snowboard bindings allow the snowboard rider to change the angle of the boot attachment for the purpose of accomplishing more "tricks". Each binding has a board anchor plate (15), a boot anchor (26), a biasing unit (21), and a locking unit (22). The board anchor plate (15) can include an angle set plate (16) to enable the rider to change the binding alignment on the snowboard. The usual straps (59and 60) are attached to the boot anchor (26) and a heel holder (29) are used to lock the boot in place. A biasing unit (21) (50A) utilizes one or more hinges (32 and 33) (50)(67) and a biasing mechanism. The biasing mechanism can be a coiled spring(s) (23)(68), an elastomeric wedge (40), a leaf spring (47), and/or a torsion bar (51), etc. The biasing mechanism forces the board anchor plate (15) and the boot anchor (26) into parallel alignment. This alignment can be changed by the user by releasing the board anchor plate (15) and the boot anchor (26) from parallel alignment by retracting the locking pin (24).

15 Claims, 8 Drawing Sheets

LATERALLY FLEXIBLE SNOWBOARD BINDING SYSTEM

BACKGROUND OF THE INVENTION

The art of snowboarding is an amalgam of technology derived principally from the ski and skateboard industries. Ski industry manufacturers provided high technology snowboard construction, "rigid downhill" and flexible "cross country" boots and bindings. Skateboard manufacturers provided the board plan configuration. More importantly, skateboarding provided the riding techniques necessary for so many of the "tricks" available to the snowboard rider.

The desire by snowboard riders to do all of the tricks available to the skateboarder has led to changes in both board, boot, and binding designs.

The downhill racing snowboard rider still uses high rigid boots similar to those used by downhill skiers. However, the freestyle riders are using shorter, more flexible hybrid and soft boots to allow more freedom for ankle movement.

The racing snowboard rider uses a plate binding which has dropped the release mechanism used with skis, kept the toe and heel clamps and added a mechanism for canting and binding angle adjustment.

Those snowboard riders who delight in freestyle action use either snowboard bindings from which the toe and heel clamps have been removed and straps added or "step-in" bindings which have dropped the straps and added toe and heel clamps.

The shorter softer boots still provide much of the protection for the ankle that is provided by the taller, harder boot while providing freedom for the rider with respect to the board. Still more freedom is required if the rider is to emulate all of the tricks, e.g., "tweaking out", available to the skateboarder.

This invention provides the additional freedom needed for such tricks. It allows the rider to adjust the pitch of the binding, so that the front and rear legs are more parallel with the plane of the body of the board. At the same time, it provides the across board rigidity and binding positioning necessary for snowboard riders to change their stance by changing the exterior angle (cant) of each of the board anchor and/or boot anchor vis a vis their alignment with the length of the board.

SUMMARY OF THE INVENTION

Snowboard bindings enabling the rider to have good vertical rotation toward the front of the board are created by separating the canting and/or binding, i.e., the board anchor plate, angle providing, element(s) from the boot anchor element(s)) and adding hinge and bias mechanisms which strongly bias the board anchor plate and the boot anchor toward a substantially parallel position to maintain a predetermined alignment between these elements except under predetermined conditions, e.g., when the snowboard rider desires to do certain tricks requiring the rider's legs and the front or rear portion of the board to be substantially parallel, i.e., to be "tweaked out."

BRIEF DESCRIPTION OF THE FIGURES

FIGS. 1 and 2 show opposite sides of a preferred binding in a "closed" position. FIGS. 3 and 4 provide a view of opposite sides of the model in the "open" position.

DETAILED DESCRIPTION OF THE DRAWINGS

The numbers used in the Figures usually remain the same from Figure to Figure for elements which are common. Variances are designated by letters.

Figure 1:
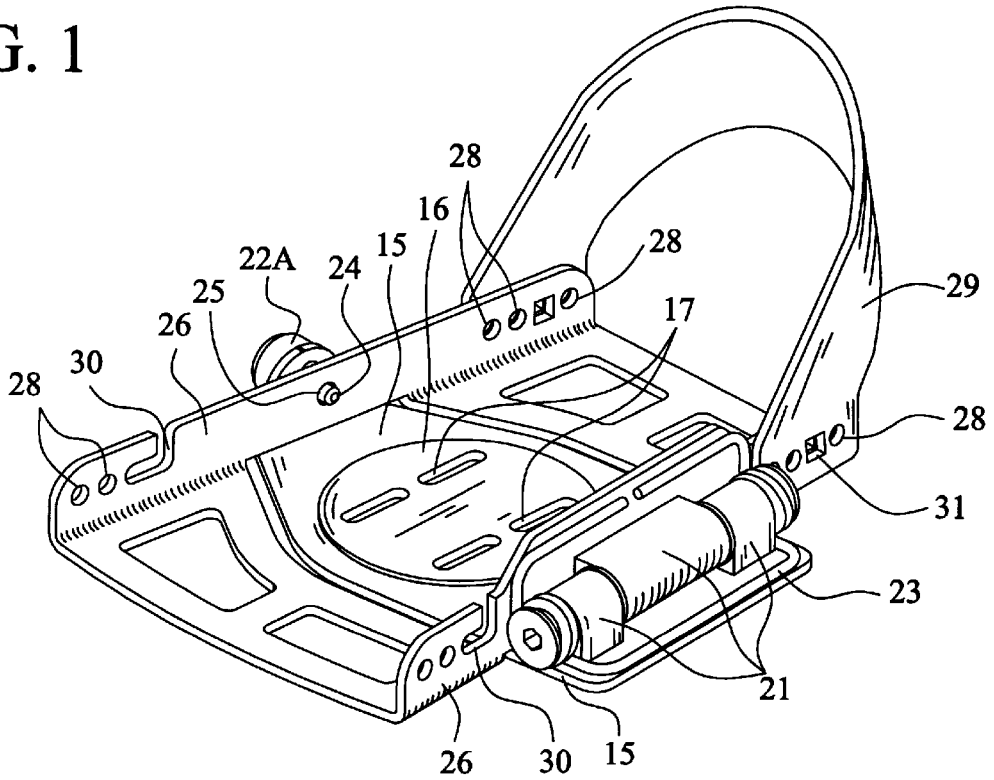
FIGS. 1–4 are simplified perspective view of a preferred model.
Figure 2:
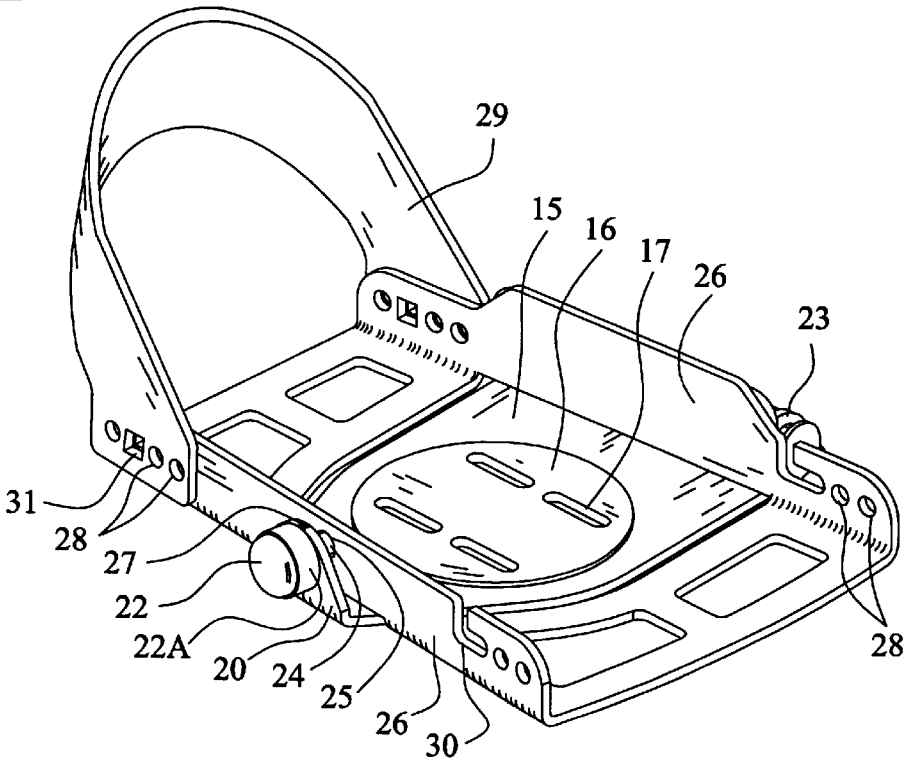
Figure 3:
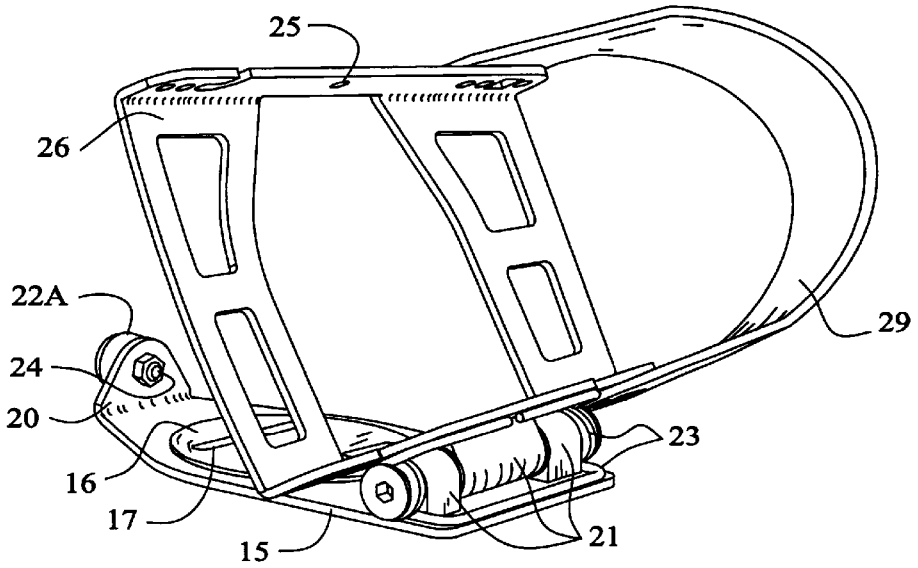
Figure 4:
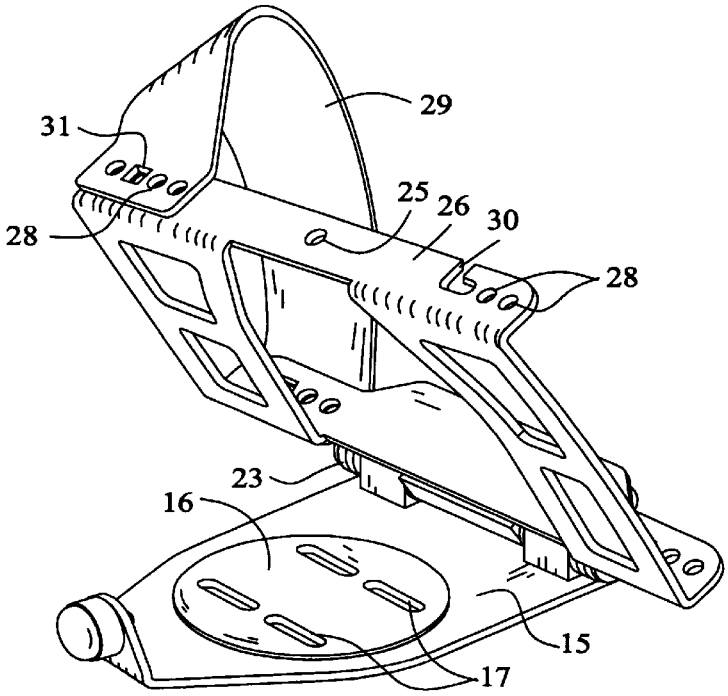

FIGS. 1–4 detail a form of the preferred model of the new binding. FIG. 1 shows a snowboard anchor plate 15 which is attached to the board through angle set plate 16. Plate 16 has slots 17 through which screws are driven into the snowboard. The lower edges of plate 16 preferably have beveled gear teeth which fit into complementary gear teeth (neither shown) in anchor plate 15. This gear arrangement is utilized in a number of commercial binding designs. Slots 17 allow the binding to be moved "across" the snowboard to modify the amount of boot heel or toe which protrudes over each of the edges of the snowboard.

Board anchor plate 15 is attached, on one side to a biasing unit 21 and on the other to a locking unit 22. The biasing unit is made up of a hinge and coil spring 23 (See FIG. 5). The amount of bias tension can be adjusted via changing the spring 23 used in terms of spring size, composition, configuration, etc.

The exemplary locking unit 22 is made up of a handle and a locking pin 24. The locking unit 22 can be cam operated or spring operated to insert locking pin 24 within a slot, depression or hole 25 laterally, vertically at a slant angle or in parallel.

Here, locking unit handle 22A is mounted on an extension 20 of plate 15 and combines an alignment key (not shown) with a ball point pin type retractor mechanism (not shown). For usage, the handle cap 22A must be pulled away from boot anchor 26 and the point of an indicator arrow aligned with a mark 27 on anchor extension 20. The handle cap 22A is then pushed inwardly to extend or retract locking pin 24.

Binding and safety straps are attached by those means commonly utilized in the industry. Here, binding straps (not shown) are attached to boot anchor 26 by being bolted through holes 28. A heel "holder" or "cup" 29 fits around the boot above the point where it expands for the heel of a foot. Hole 31 is provided for attachment or safety straps or other devices. Recesses 30 can be utilized to anchor boot toe pins (not shown) of step in boots.

Figure 5:
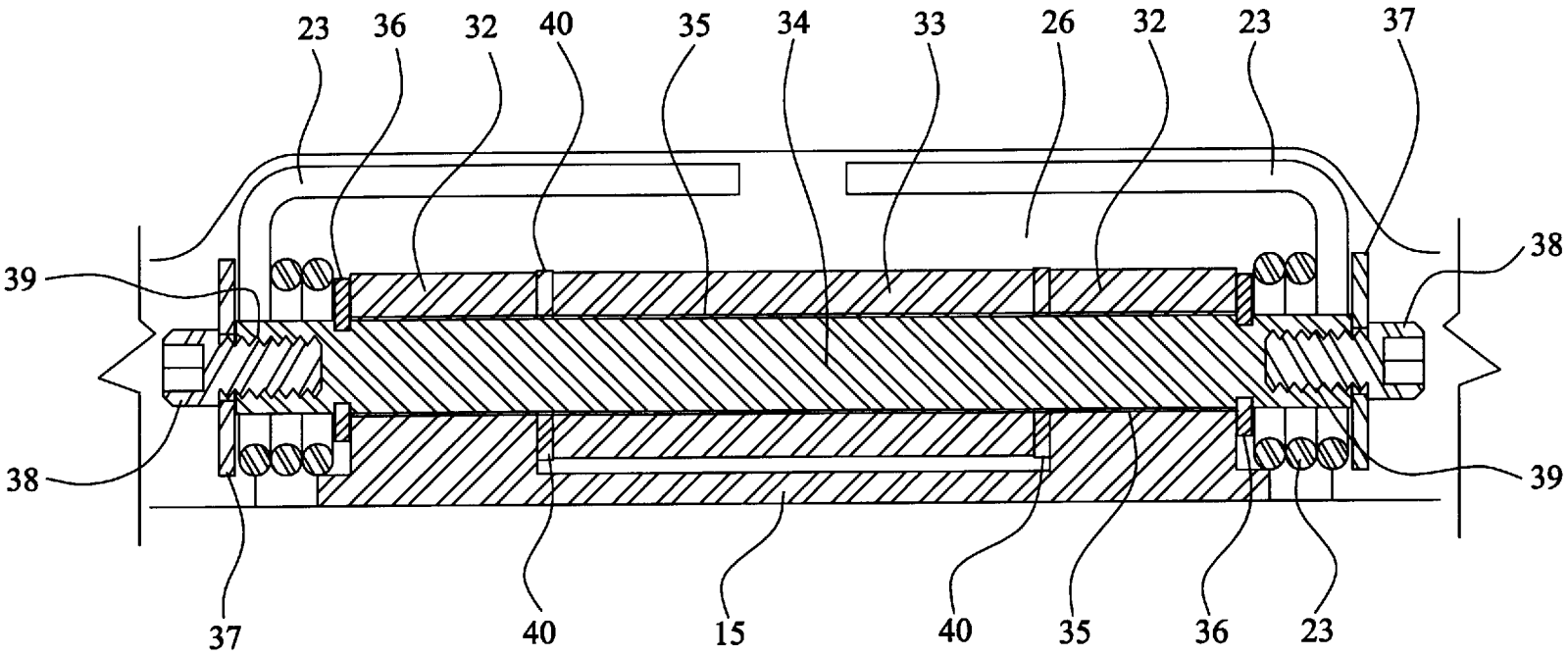
FIG. 5 depicts one configuration of a hinge and bias mechanism useful with the model of FIGS. 1–4.

FIG. 5 is a partial sectional view of a biasing unit 21 with its hinge elements 32 and 33 and coiled spring 23. A rod 34 fits into bore 35. A plastic or metal "C" clip 36 positions rod 34. Washer 37 and bolts 38 hold spring 23 in the biasing position via bolt holes 39.

Figure 6:
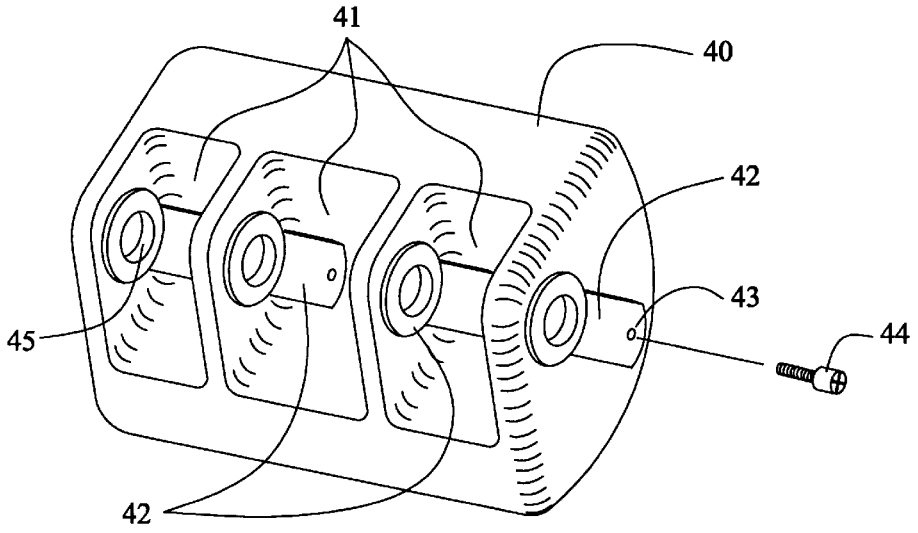
FIG. 6 is a perspective view of an elastomeric compression wedge useful as a part of the biasing mechanism.

The elastomeric wedge 40 used as the biasing mechanism of FIG. 6 has three slots 41. Metal inserts 42 are bonded to the sides of each of slots 41. Inserts 42 each have holes 43 at their remote ends which extend completely through wedge 40. The holes at the remote end and bolt 44 (cut off) serve to ensure that the biasing unit 21 and its wedge 40 remains intact during usage.

The holes 45 at the near end also extend completely through the wedge 40 and are complementary with the bores 56 and 56A in modified anchors 32 and center part 33 when in place, bolt 34 is inserted through them to form hinge 21.

Figure 7:
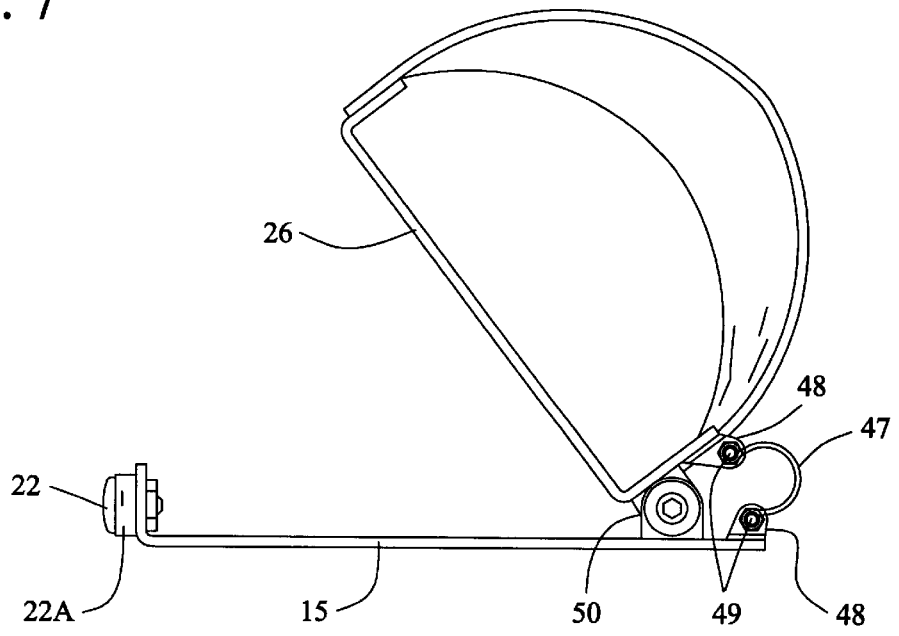
FIG. 7 shows the use of a leaf spring for the same purpose.

FIG. 7 shows a leaf spring 47 with terminal eyelets (not shown) attached to anchor points 48 by bolts 49. Hinge 50 is separated from the bias mechanism of this model.

Figure 8:
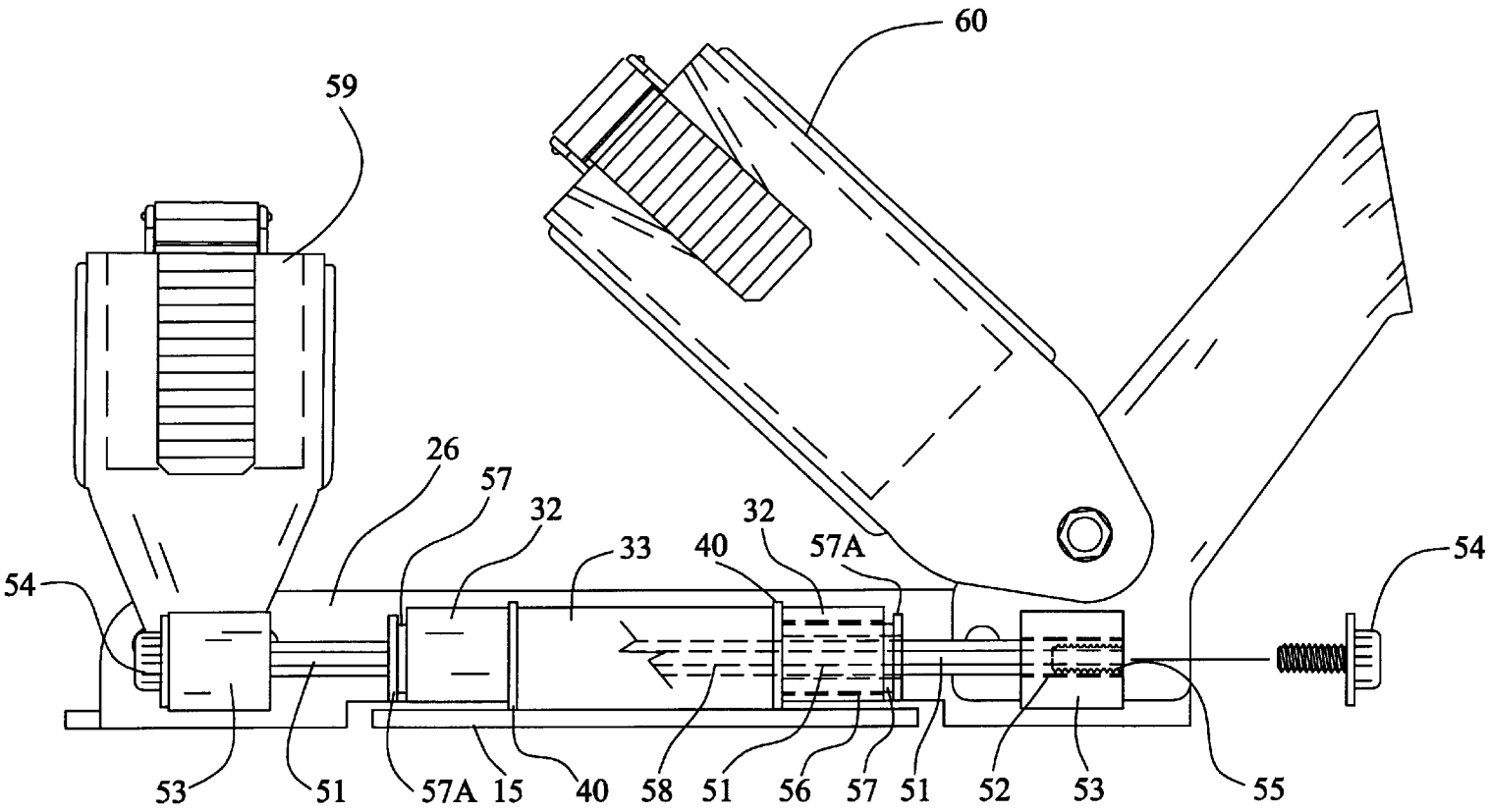
FIG. 8 is a side view of a model using torsion bars as the biasing mechanism.
Figure 9:
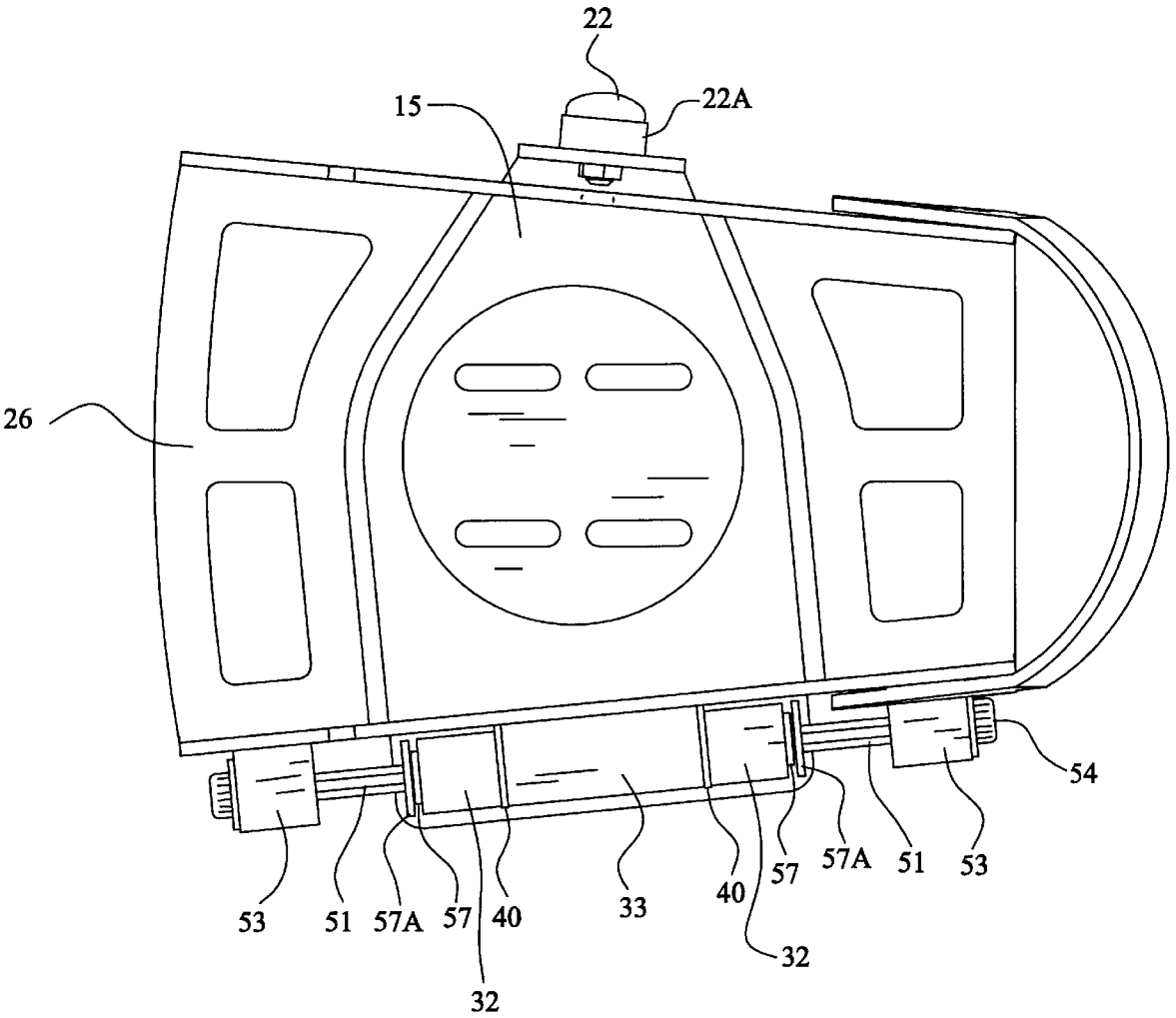
FIG. 9 is a top view of the model of FIG. 8.

FIGS. 8 and 9 show one hexagonal torsion bar 51 mounted end to end with opposite ends of a hinge unit. Internal details are depicted only at the right end of the biasing mechanism of FIG. 8. Springs 23 are omitted for simplicity.

In FIGS. 8 and 9, hexagonal torsion bars 51 pass through bores 52 in bosses 53 and are held in place by bolts 54 which are screwed into threaded holes 55. Bars 51 pass through and rotate freely within enlarged bores 56 in anchors 32. The bars 51 are fitted with a round nylon, polyformal or other quasi lubricating material sleeve 57 which has a hexagonal center. The sleeves 57 act as bearings and facilitate rotation of bars 51 within bores 56. Sleeves 57 are held in place by "C" clips 57A. The bore 56A is hexagonal and does not permit rotation of bar 51 within center part 33. When boot anchor 26 rotates toward the ends of the board, and anchor plate 15 remains fixed, the torsion bars 51 are twisted. The resilience of the bars 51 operating against the twist returns the boot anchor 26 towards a position horizontal to the snowboard. The straps 59 and 60 anchor the binding system to the user's boot.

Figure 10:
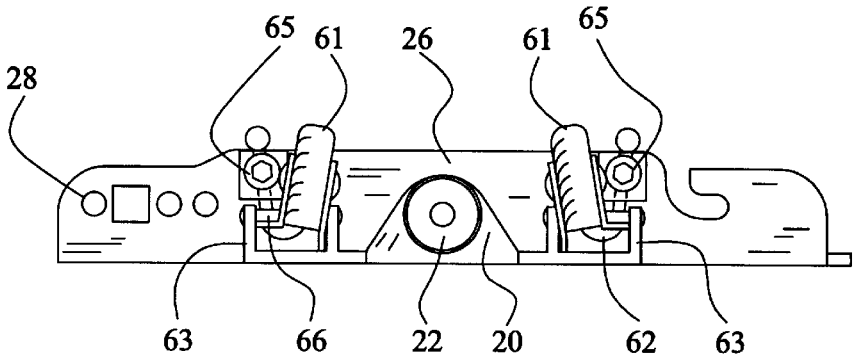
FIGS. 10 and 11 are a side view and a simplified end view of a model where the spring is mounted on the binding on the side opposite to the hinge.
Figure 11:
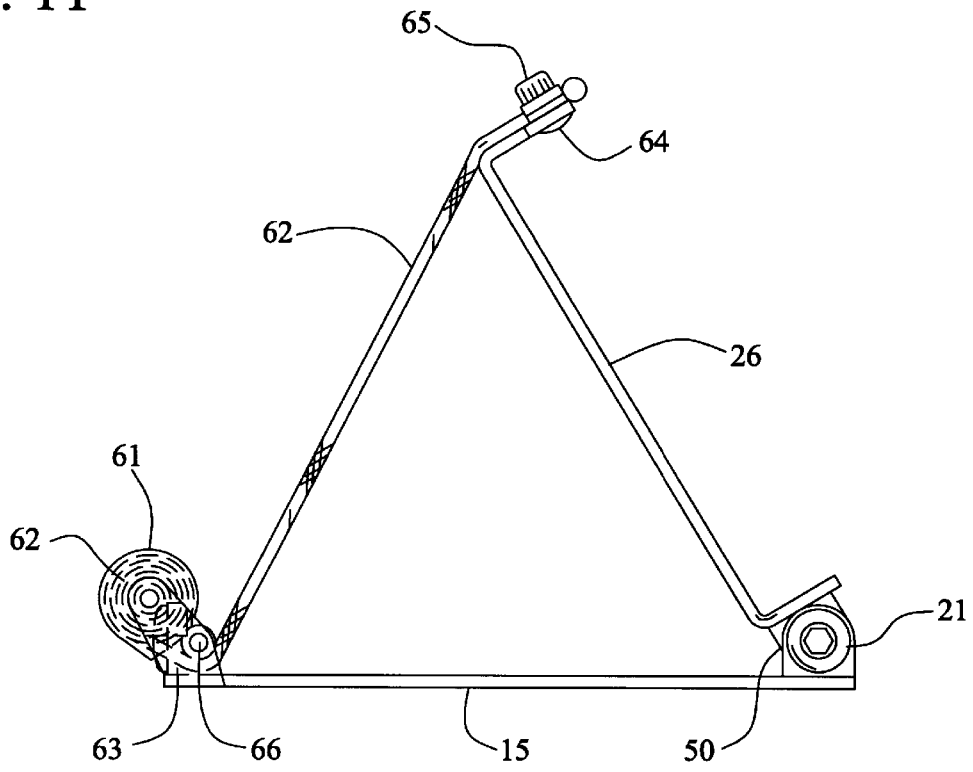

The biasing mechanism of simplified FIGS. 10 and 11 is a case 61 containing a prestressed coiled spring (not shown) connected to an Aramid or woven steel cord 62. Case 61 is mounted on bracket 63 which is a part of or attached to board anchor 15. Cord 62 is attached to anchor 26 by a nut 64 and bolt 65 and descends downwardly and curves around roller 66 before feeding into case 61.

Figure 12:
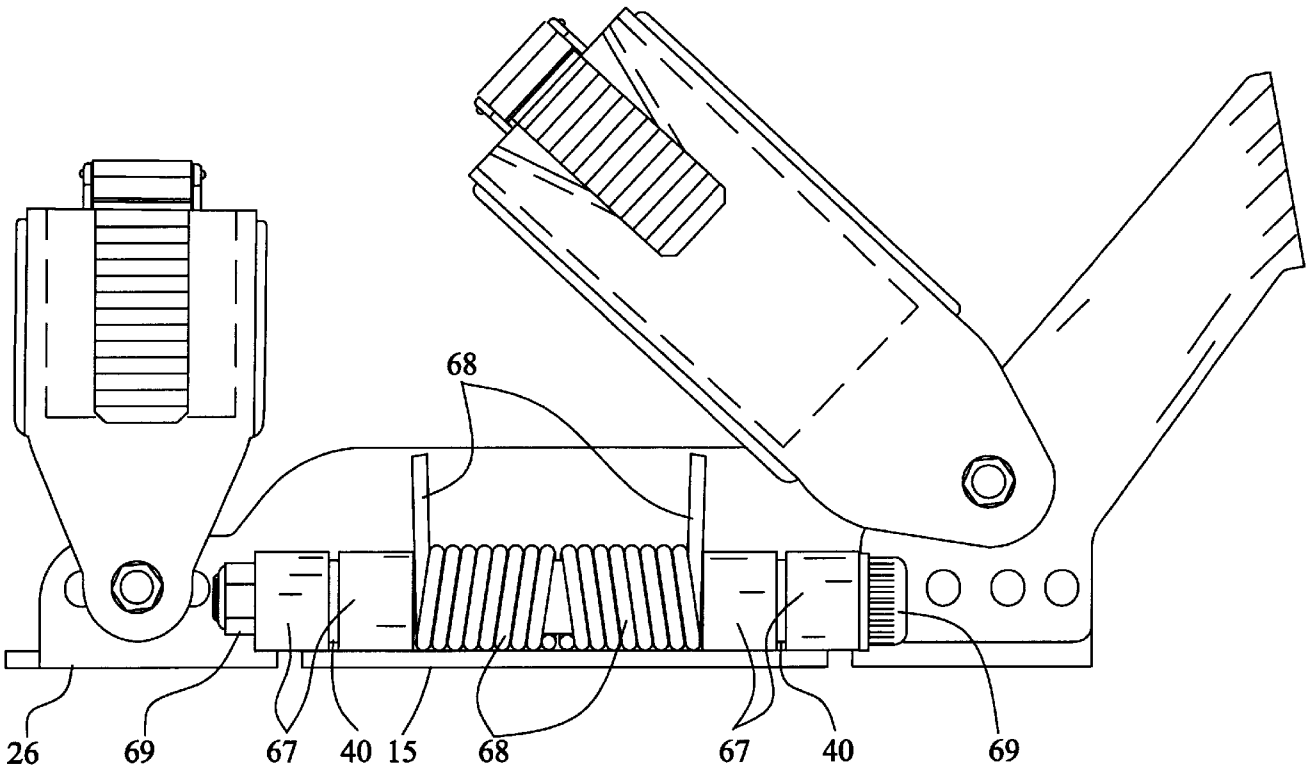
FIG. 12 is a simplified side view of a preferred double bias spring arrangement shown without a cover.

FIG. 12 depicts a snowboard anchor plate 15 and boot anchor 26 positioned in parallel by hinges 67 and two coiled springs 68 held in place by nut and bolt 69.

GENERAL DESCRIPTION OF THE INVENTION

The snowboard bindings are made of materials commonly used in the snowboard industry and are attached to the snowboards by commonly used means. Thus, the bindings, per se, are normally made of a metal, e.g., an aluminum or stainless steel alloy. The various straps will usually be made of plastic and/or synthetic fiber materials. The heel holder can be integral with the boot anchor or attached thereto. It can be coated with solid plastic materials or foamed elastomeric materials to protect the snowboard rider and the boots.

A variety of biasing units have been shown as the function of this element can be accomplished in a variety of ways. The locking units also can be quite varied and can have the configurations, for example, used in the briefcase and suitcase industry where a key or combination lock is combined with various types of blocking mechanisms to prevent theft. The locking mechanism can also be operated, using a remotely actuated trigger connected to the lock element by a flexible cable position within an equally flexible tube as is done with odometers.

Anchor point recesses for boot toe pins can be positioned as shown or centered on the leading edge of the boot to fit into a single hole in a boot anchor mechanism with a center holed member (not shown) circling the front edge of a bootspace.

While a basic binding configuration is depicted for use with the boot anchor, it is merely a generic form and can easily be modified as needed for the casual rider, a professional and/or the handicapped.

Now having described my invention, what I claim is:

1. A snowboard binding system comprising:

snowboard anchor plate means, for attachment of the system to a snowboard, rotationally attached to boot anchor means by hinge means;

boot anchor means rotationally attached to the snowboard anchor means by a bias unit means;

bias unit means including:

hinge means enabling rotational movement between the snowboard anchor plate means and the boot anchor means positioned on one side of the snowboard binding system; and bias mechanism means for maintaining the snowboard anchor plate means and the boot anchor means in substantially parallel alignment; and locking means, releasable by a snowboard rider for maintaining the snowboard anchor plate means and the boot anchor means in a substantially parallel relationship, except when the locking means is released by the snowboard rider.

2. The snowboard binding system of claim 1 wherein the snowboard anchor plate means further includes a rotatably attached angle set plate intermediate its opposite sides.

3. The snowboard binding system of claim 1 wherein the biasing unit means includes a spring means for proximately positioning the snowboard anchor plate means and the boot anchor means toward a substantially parallel position.

4. The snowboard binding system of claim 3 wherein the spring means is coiled.

5. The snowboard binding system of claim 3 wherein the spring means is a leaf spring.

6. The snowboard binding system of claim 3 wherein the spring means is a torsion bar.

7. The snowboard binding system of claim 3 wherein the spring means is one of an elastomeric or composite material wedge.

8. The snowboard binding system of claim 3 wherein the biasing mechanism is remotely positioned on the side of the anchor plate means opposite to the hinge means.

9. The snowboard binding system of claim 8 wherein the biasing mechanism is a prestressed coiled spring.

10. The snowboard binding system of claim 1 wherein the snowboard anchor plate further includes a heel cup holder positioned on one end.

11. The snowboard binding system of claim 1 wherein the boot anchor means includes means for anchoring snow board boots.

12. The snowboard binding system of claim 11 wherein the means for anchoring snowboard boots includes at least one hole or recess.

13. The snowboard binding system of claim 1 wherein the boot anchor means includes hole means for attachment of straps.

14. The snowboard binding system of claim 1 wherein the locking unit means includes a lock unit spring.

15. The snowboard binding system of claim 14 wherein the locking unit means includes a locking spring.

* * * * *